US005186127A

United States Patent [19]

Cuatico

[11] Patent Number: 5,186,127

[45] Date of Patent: Feb. 16, 1993

[54] INTERNAL COMBUSTION ENGINE WITH OFFSET CONNECTING JOURNAL

[76] Inventor: Lorenzo Cuatico, 2113 M.L. Carreon St., Sta. Ana, Manila, Philippines

[21] Appl. No.: 646,176

[22] Filed: Jan. 28, 1991

[51] Int. Cl.[5] ..... F02B 75/06

[52] U.S. Cl. ..... 123/54 R; 123/197.4

[58] Field of Search ..... 123/197.1, 197.4, 48 B, 123/48 R, 78 R, 54 R, 54 B

[56] References Cited

U.S. PATENT DOCUMENTS

| | | | |
|---|---|---|---|
| 1,946,718 | 2/1934 | Stathas | 123/197.1 |
| 4,131,094 | 12/1978 | Crise | 123/48 B |
| 4,174,684 | 11/1979 | Hallmann | 123/48 B |
| 4,311,190 | 7/1980 | Indech | 123/48 B |
| 4,505,239 | 3/1985 | Deland | 123/197.4 |
| 4,567,866 | 2/1986 | Schubert | 123/197.1 |
| 4,664,077 | 5/1987 | Kamimaru | 123/54 R |
| 4,690,113 | 9/1987 | Deland | 123/197.4 |
| 4,708,096 | 11/1987 | Mroz | 123/54 R |
| 4,945,866 | 8/1990 | Chabot, Jr. | 123/54 R |
| 5,076,220 | 12/1991 | Evans et al. | 123/197.4 |

FOREIGN PATENT DOCUMENTS

| | | | |
|---|---|---|---|
| 21332 | 8/1906 | United Kingdom | 123/197.4 |
| 1576242 | 10/1970 | Fed. Rep. of Germany | 123/197.1 |
| 2855667 | 7/1980 | Fed. Rep. of Germany | 123/54 R |
| 2593232 | 7/1987 | France | 123/197.1 |
| 2219345 | 12/1989 | United Kingdom | 123/54 R |

*Primary Examiner*—David A. Okonsky

[57] ABSTRACT

An internal combustion engine of the type having at least one piston cylinder, a piston reciprocating within each of said cylinder, an off-set crankshaft disposed at a predetermined distance sidewardly from the vertical axis of the cylinder counter to the direction of rotation of said crankshaft and a connecting rod connecting the crankshaft to said piston whereby said connecting rod is provided with off-set journal pivotally secured to the wrist pin centrally within the hollow portion of said piston with the center line of said connecting rod is disposed at predetermined distance sidewardly from the vertical axis of the piston wrist pin towards the direction of the rotation said crankshaft.

3 Claims, 5 Drawing Sheets

INTERNAL COMBUSTION ENGINE WITH OFFSET CONNECTING JOURNAL

BACKGROUND OF THE INVENTION

The present invention relates generally to internal combustion engine but more particularly to an upgraded internal combustion engine have mechanical alteration to the connection of the piston and connecting rod to improve its performance.

Heretofore, conventional internal combustion engine, since its inception, and up to the present is built in a manner where the cylinder center axis always intersects the longitudinal axis of the crankshaft. Thus, when the reciprocating piston is on the dead center, the connecting rod lies vertically along the axis of the cylinder and the crankshaft. It was then realized that there is big power loss in the execution of the power stroke since the force in turning the crankshaft is gradually reduced up to the 90 degree turn of the crankshaft with respect to its vertical axis or the first quarter turn which is the most critical period of the power transmission. The force being transmitted by the connecting rod to the crankshaft is maximum when in the vertical position. Said force is reduced by the counter-force inherent to the crankshaft and further during the first quarter turn since the connecting rod creates a resultant force equal to the maximum force times cos $\theta$ which is lesser than the force being delivered when the connecting rod is in the vertical position ($\theta$ is the angle created by the connecting rod between the vertical axis of the cylinder and the center line of the connecting rod).

Since it is the desire to lessen the power loss of the aforementioned engine and to utilized as much power created by the combustion, some have moved the crankshaft sidewardly such that the vertical axis of the crankshaft and that of the cylinder lies in different planes and in order that the connecting rod would be substantially vertical in position as it approaches the 90 degree turn or the first quarter turn of the crankshaft. Such, however, is not possible without additional mechanical alteration as the connecting rod would be in contact with lower edge of the cylinder in the return stroke of the piston. An example of this alteration is by placing the piston wrist pin, where the connecting rod is attached, at lower portion of the piston. This alteration would free the connecting rod from the lower edge of the cylinder during the return stroke of the piston.

The initial findings of the engine appears satisfactory as the performance of the engine is improved by 20% more than the conventional. However, after a period of time, indication of unequal pressure being applied to the side wall of the cylinder is found as evidently shown by some scratches at the upper portion on one side of the cylinder and at the lower opposed side thereof. This defect is due to the positioning of the piston wrist pin at the lower portion of the piston. The push of the connecting rod to the piston wrist pin creates a sideward force that presses the lower portion of the piston to cylinder lower side wall resulting to the tilting of the piston. This construction therefore, applies imbalance pressure to the sidewall of cylinder that easily wears either the sidewall of the cylinder or the piston rings of the piston.

SUMMARY OF THE INVENTION

The primary object of this invention therefore, is to provide an internal combustion engine that reduces the power loss due to drag and increases the performance thereof.

Another object of this invention is to provide an internal combustion engine having a connecting rod which is substantial vertical in position as it pushes the crankshaft in the first quarter turn thereof.

Still an object of this invention is to provide n internal combustion engine having an off-set connecting rod journal to give enough gap between the lower edge of the cylinder liner and the connecting rod during the exhaust and compression stroke of the piston.

According to the present invention, the internal combustion engine comprises a conventional engine block having a least one piston cylinder defining a combustion chamber and a piston slidably provided therein. The crankshaft of the engine is laterally moved in a manner that its vertical axis and that of the piston cylinder do not lie in the same plane, and such that the connecting rod is substantially vertical in position as it turns the crankshaft at about 90 degrees from the vertical axis or about to finish the first quarter turn of said crankshaft. Also, the journal of the connecting rod which is pivotally connected to the piston wrist pin is off-settled sidewardly along the direction of the crankshaft such that the center line of the connecting rod does not lie with the center vertical axis of the cylinder. The off-setting of the connecting rod journal is necessary in order to provide a gap or clearance and the connecting rod during the return stroke of the engine.

DETAILED DESCRIPTION

Figure 1:
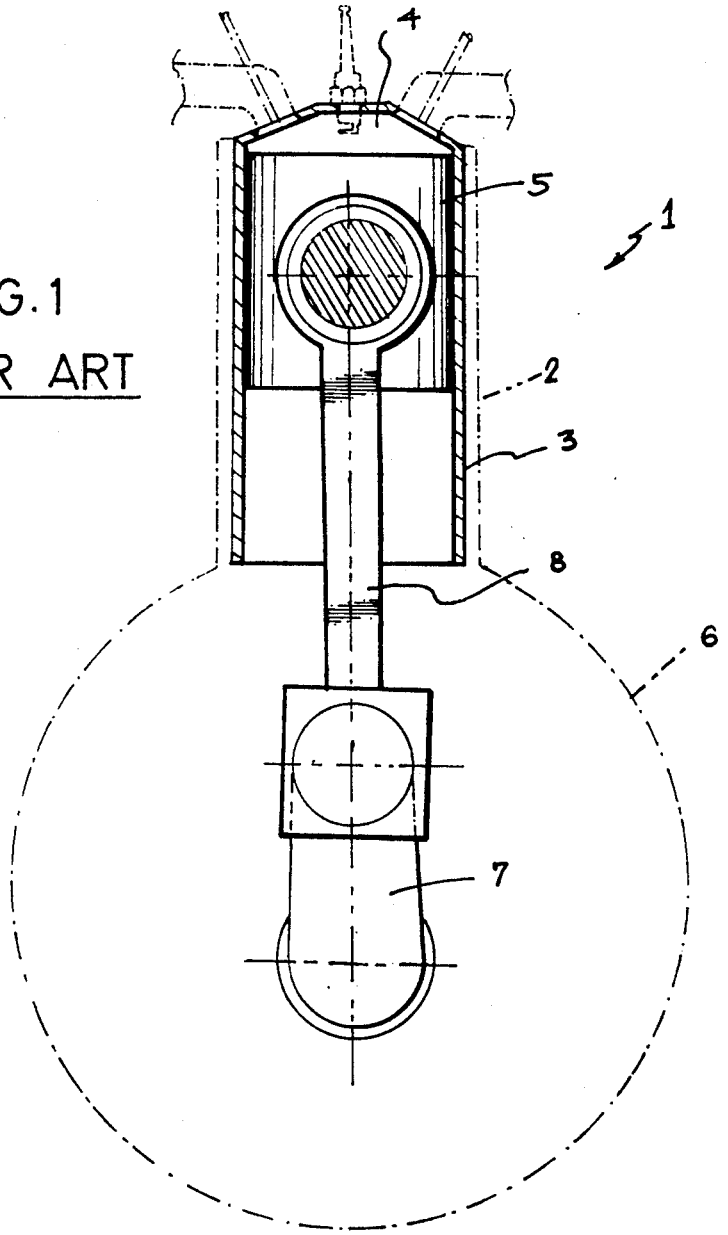
FIG. 1 PRIOR ART
FIG. 1 is a simplified illustrative view of the conventional prior art internal combustion engine.

FIG. 1 shows a conventional internal combustion engine 1 comprising an engine block 2 confining at least one piston cylinder 3 having a combustion chamber 4 where a piston 5 is reciprocably housed. Said engine 1 is also provided with a crank case 6 enclosing within a crankshaft 7 which in turn is rotatably driven by a connecting rod 8 journalled to said piston 5. As shown in said drawings, the vertical axis of the cylinder and that of the crankshaft 7 lies on the same plane.

It is known that to improve the performance of the engine, the crankshaft should be moved sidewardly to left or counter to the direction of rotation of said crankshaft such that the connecting rod would be substantially vertical at the middle of the power stroke or substantially 90 degrees from the vertical axis of said crankshaft. Such arrangement would utilize the maximum power of the combustion as the power is maximum when the connecting rod is at the vertical position.

Figure 2:
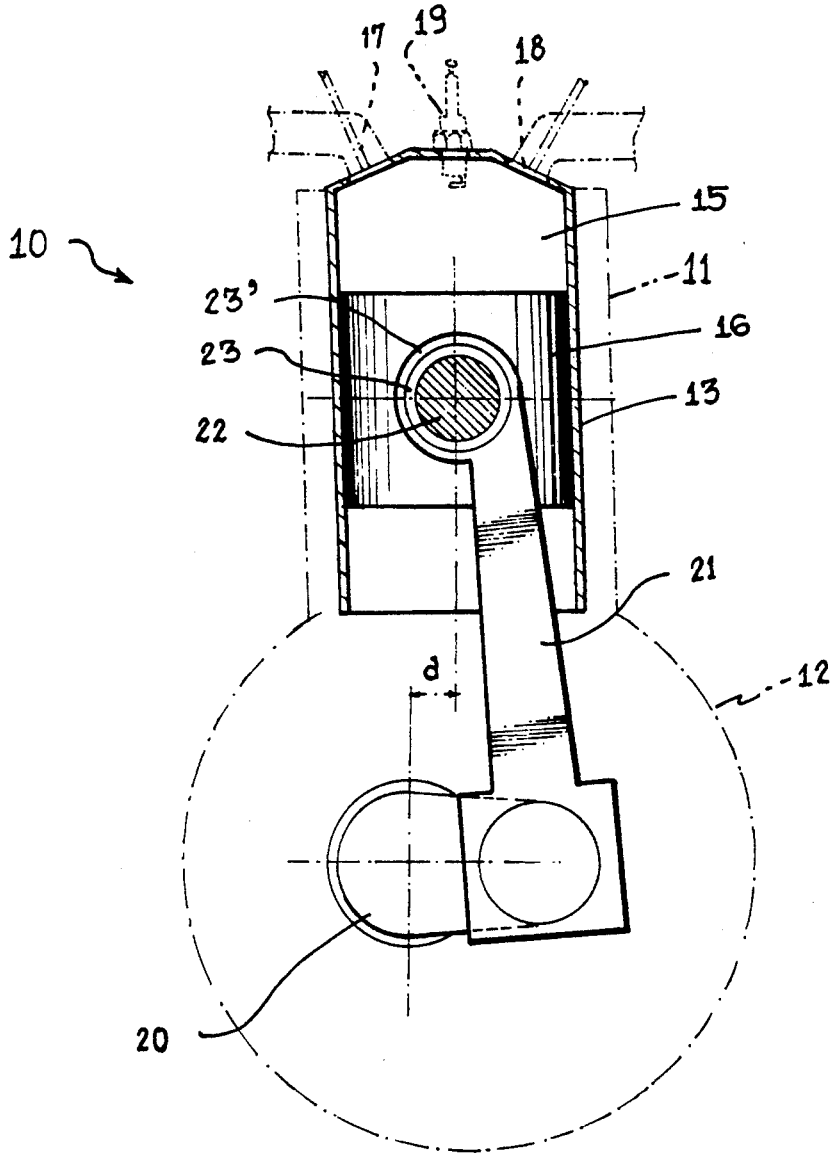
FIG. 2 is a simplified illustrative view of the internal combustion engine showing the position of the connecting rod during the power stroke of the piston according to the present invention.
Figure 3:
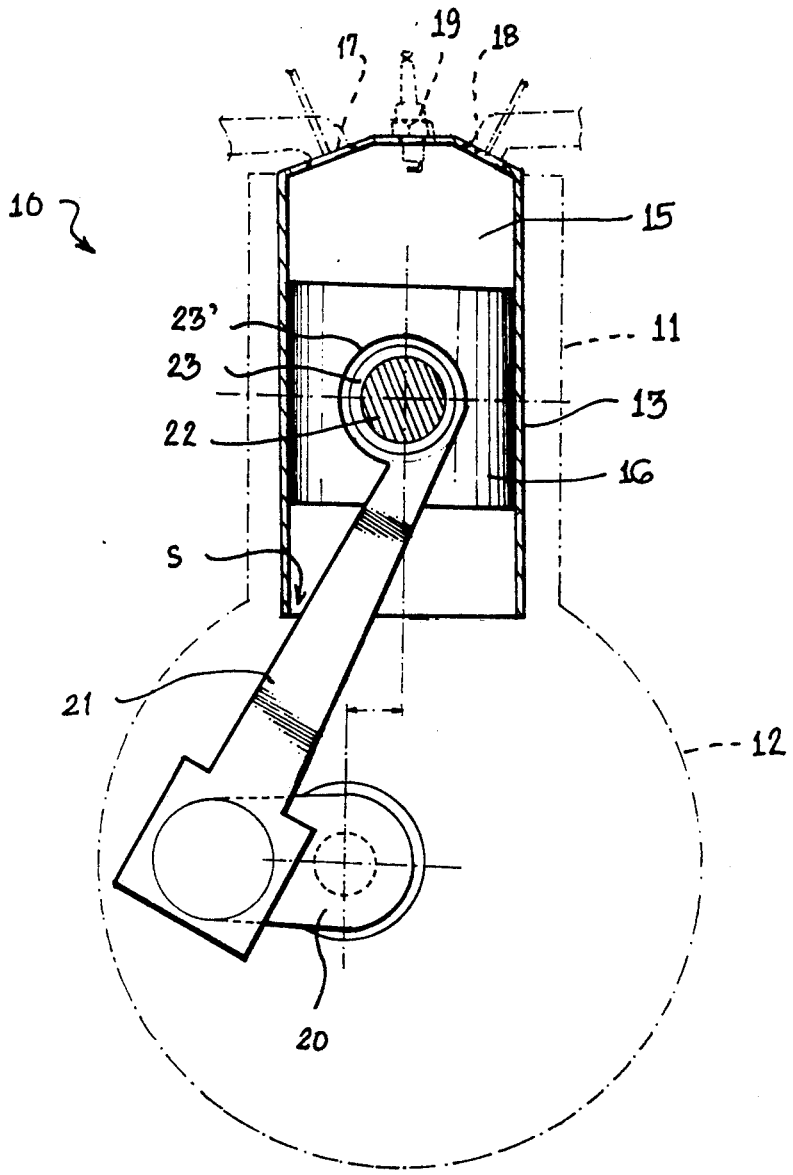
FIG. 3 is a simplified illustrative view of the same engine showing the return stroke of the piston according to the present invention.

FIGS. 2 and 3 shows the modified version of the internal combustion engine 10 which is in accordance with the present invention. Other parts of said engine 10 were no longer shown and need not be described as they are well-known structural elements and not relevant to the present invention.

The internal combustion engine 10 has an engine block 11 and a crankcase 12 disposed below said engine block 11. In said engine block 11, is at least one piston cylinder 13 defining a combustion chamber 15 where a piston 16 is reciprocably provided, an intake valve 17 where air and fuel enters, an exhaust valve 18 where the products of combustion exits and a spark plug 19 that ignites said fuel which causes the power stroke of the piston 16.

The crankcase 12 houses a crankshaft 20 which is longitudinally disposed therein. The drawings, however, shows only a crossectional view of said crankshaft 20 that is rotatably connected to one end of the connecting rod 21. The opposed end of the connecting rod 21 is journalled to the piston wrist pin 22 located centrally within the hollow portion of said piston 16 via bearing 23. As clearly shown in FIGS. 2 and 3, the crankshaft 20 is moved sidewardly to the left of the vertical central axis of the piston cylinder 13 at a predetermined distance "d" from said central axis of the cylinder 13 counter to the direction of the crankshaft 20 rotation, such that the vertical axis of the cylinder and that of the crankshaft do not lie on the same plane. The upper end of the connecting rod 21 which is connected to the piston wrist pin 22 has an off-set journal 23' whereby the center line of said connecting rod is held at distance to the right of the vertical axis of the piston wrist pin 22.

The distance between the vertical axis of the cylinder 13, the crankshaft 20 and further with the center line of the connecting rod was carefully determined such that in the power stroke of the piston 16, the connecting rod 21 would be substantially vertical as the crankshaft 20 approaches the 90 degree turn in order to transmit the maximum power produced by the combustion of fuel within the cylinder. It is also noted that in the upward stroke of the piston, either the exhaust or compression stroke, the connecting rod 21 is free from an engagement with the edge of the piston cylinder 13 as a gap "S" has been formed between said edge of the cylinder 13 and connecting rod 21 due to the off-setting of the connecting rod journal 23'.

Figure 4:
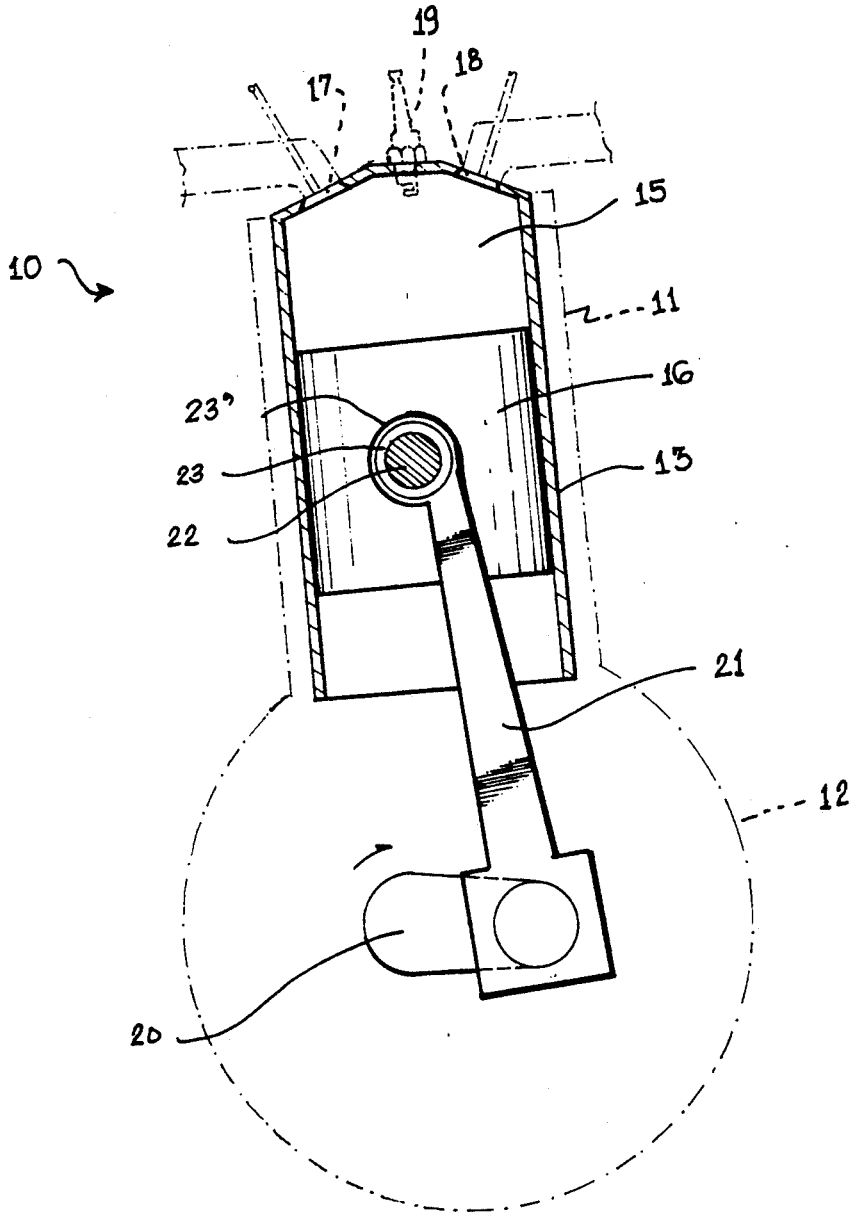
FIGS. 4 and 5 are simplified illustrative views of an slanted engine modifying the present invention.
Figure 5:
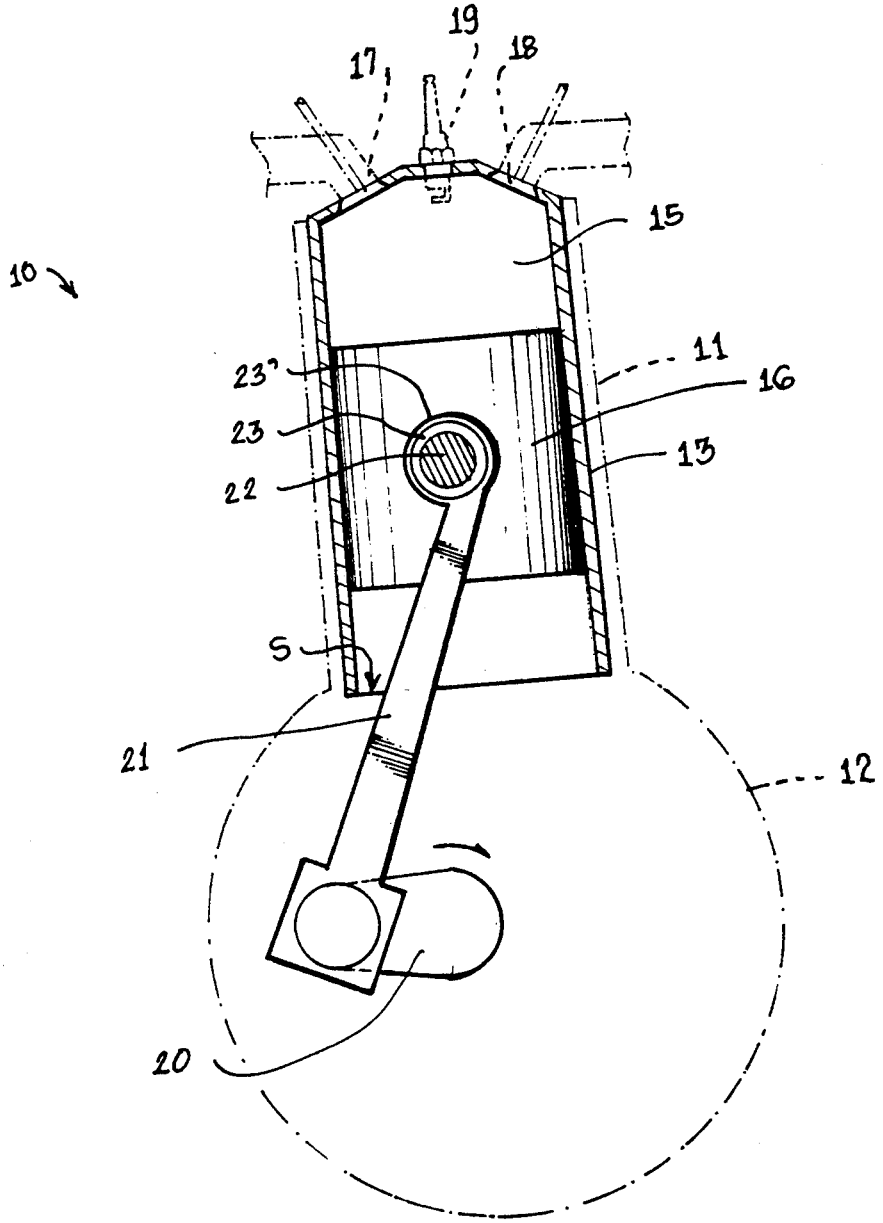

Some engine has been opted to be made slanted such as shown in FIGS. 4 and 5 of the drawing. Said engines would also be provided with an off-set journal to the connecting rod similar to the construction of the engine shown in FIGS. 2 and 3.

I claim:

1. In an internal combustion engine of the type comprising an engine block, a crankcase disposed below said engine block, at least one piston cylinder provided in said engine block, a piston reciprocally disposed in each piston cylinder, each of said pistons being connected via a connecting rod to a rotatable off-set crankshaft longitudinally disposed within said crankcase, said crankshaft being disposed at a predetermined distance from the vertical axis of the cylinder sidewardly counter to the direction of said crankshaft, the improvement wherein, the upper end of the connecting rod being pivotally connected centrally to the hollow portion of said piston is provided with an off-set journal whereby the center line of said connecting rod is disposed at a predetermined distance sidewardly from the vertical axis of the piston during a downward stroke of the piston along the direction of rotation of said crankshaft.

2. An internal combustion engine according to claim 1 wherein a substantial gap is formed between the connecting rod and the lower edge of the piston cylinder on the upward stroke of said piston.

3. An internal combustion engine according claims 1 or 2 wherein the connecting rod is substantially vertical in position as the crankshaft approaches the 90 degree turn with respect to the vertical axis of said crankshaft in order to deliver the maximum power created by the power stroke.

* * * * *